US009046106B2

(12) United States Patent
Chan et al.

(10) Patent No.: US 9,046,106 B2
(45) Date of Patent: Jun. 2, 2015

(54) FAN AND FAN FRAME THEREOF

(75) Inventors: Wei-Lung Chan, New Taipei (TW); Chi-Jung Huang, New Taipei (TW)

(73) Assignee: COOLER MASTER DEVELOPMENT CORPORATION, Zhonghe Dist., New Taipei (TW)

( * ) Notice: Subject to any disclaimer, the term of this patent is extended or adjusted under 35 U.S.C. 154(b) by 492 days.

(21) Appl. No.: 13/586,871

(22) Filed: Aug. 16, 2012

(65) Prior Publication Data

US 2014/0050578 A1 Feb. 20, 2014

(51) Int. Cl.
*F04D 25/06* (2006.01)
*F04D 29/52* (2006.01)
*F04D 19/00* (2006.01)

(52) U.S. Cl.
CPC ..... *F04D 25/0613* (2013.01); *F04D 19/002* (2013.01); *F04D 29/522* (2013.01); *F04D 29/526* (2013.01)

(58) Field of Classification Search
CPC .... F04D 19/002; F04D 29/522; F04D 29/526
USPC ..... 417/423.14
See application file for complete search history.

(56) References Cited

U.S. PATENT DOCUMENTS 2,643,053 A * 6/1953 Sherman et al. ..... 454/354

* cited by examiner

*Primary Examiner* — Edward Look
*Assistant Examiner* — Christopher J Hargitt
(74) *Attorney, Agent, or Firm* — Winston Hsu; Scott Margo

(57) ABSTRACT

A fan includes a fan frame and a fan wheel. The fan frame includes a frame body and a first waved structure. The frame body has a wind enter side and a wind exhaust side, wherein the wind enter side is opposite to the wind exhaust side. The first waved structure is formed on the wind enter side of the frame body. The first waved structure has a plurality of first peaks and a plurality of first valleys, wherein the first peaks and the first valleys are arranged separately. The fan wheel is rotatably disposed in the fan frame.

13 Claims, 8 Drawing Sheets

FAN AND FAN FRAME THEREOF

BACKGROUND OF THE INVENTION

1. Field of the Invention

The invention relates to a fan and a fan frame thereof and, more particularly, to a fan frame with a waved structure capable of enhancing wind rate and wind current and a fan equipped with the fan frame.

2. Description of the Prior Art

Heat dissipating device is a significant component for electronic products. When an electronic product is operating, the current in circuit will generate unnecessary heat due to impedance. If the heat is accumulated in the electronic components of the electronic product without dissipating immediately, the electronic components may get damage due to the accumulated heat. Therefore, the performance of heat dissipating device is a significant issue for the electronic product.

So far the heat dissipating device used in the electronic product usually consists of a heat pipe, a heat dissipating fin and a fan, wherein one end of the heat pipe contacts the electronic component, which generates heat during operation, the other end of the heat pipe is connected to the heat dissipating fin, and the fan blows air to the heat dissipating fin so as to dissipate heat. In this manner, wind rate and wind current of the fan will influence heat dissipating effect generated by the heat dissipating device. In general, a wind enter side and a wind exhaust side of a fan frame of the fan are flat so that wind rate and wind current which the blades of the fan draws into the fan frame are limited. Accordingly, heat dissipating effect generated by the heat dissipating device is reduced.

SUMMARY OF THE INVENTION

The invention provides a fan frame with a waved structure capable of enhancing wind rate and wind current and a fan equipped with the fan frame, so as to solve the aforesaid problems.

According to an embodiment of the invention, a fan comprises a fan frame and a fan wheel. The fan frame comprises a frame body and a first waved structure. The frame body has a wind enter side and a wind exhaust side, wherein the wind enter side is opposite to the wind exhaust side. The first waved structure is formed on the wind enter side of the frame body. The first waved structure has a plurality of first peaks and a plurality of first valleys, wherein the first peaks and the first valleys are arranged separately. The fan wheel is rotatably disposed in the fan frame.

In this embodiment, the fan frame may further comprise a second waved structure formed on the wind exhaust side of the frame body. The second waved structure has a plurality of second peaks and a plurality of second valleys, wherein the second peaks and the second valleys are arranged separately.

According to another embodiment of the invention, a fan frame comprises a frame body and a first waved structure. The frame body has a wind enter side and a wind exhaust side, wherein the wind enter side is opposite to the wind exhaust side. The first waved structure is formed on the wind enter side of the frame body. The first waved structure has a plurality of first peaks and a plurality of first valleys, wherein the first peaks and the first valleys are arranged separately.

In this embodiment, the fan frame may further comprise a second waved structure formed on the wind exhaust side of the frame body. The second waved structure has a plurality of second peaks and a plurality of second valleys, wherein the second peaks and the second valleys are arranged separately.

As mentioned in the above, the invention forms the first waved structure on the wind enter side of the frame body of the fan frame. When the fan wheel rotates, the first waved structure can enhance wind rate and wind current which the blades of the fan wheel draws into the fan frame, so as to improve heat dissipating effect generated by the fan. Furthermore, the invention may further form the second waved structure on the wind exhaust side of the frame body of the fan frame. The second waved structure can enhance wind rate and wind current which the blades of the fan wheel draws out of the fan frame, so as to improve heat dissipating effect generated by the fan.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
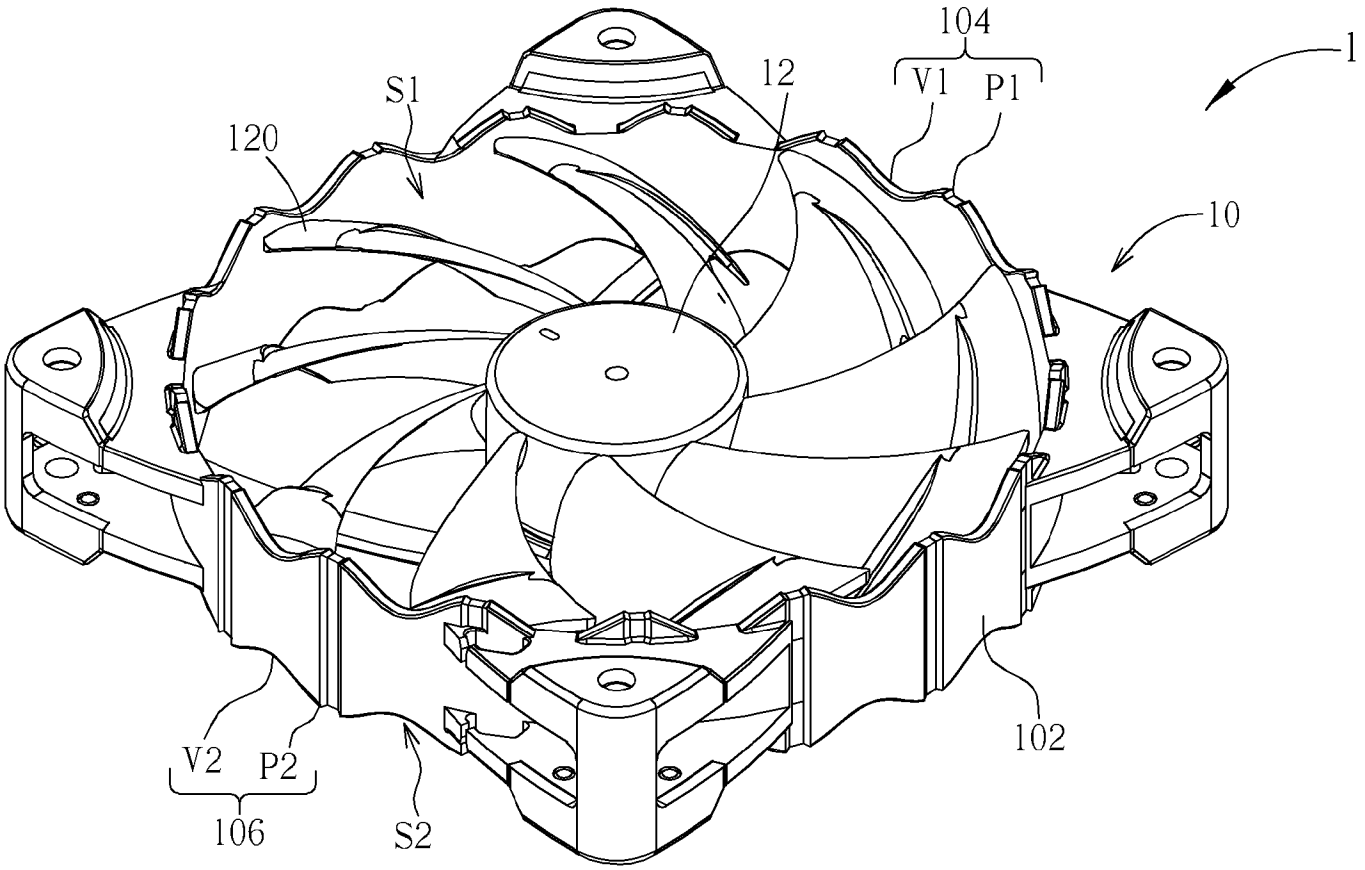
FIG. 1 is a top perspective view illustrating a fan according to a first embodiment of the invention.
Figure 2:
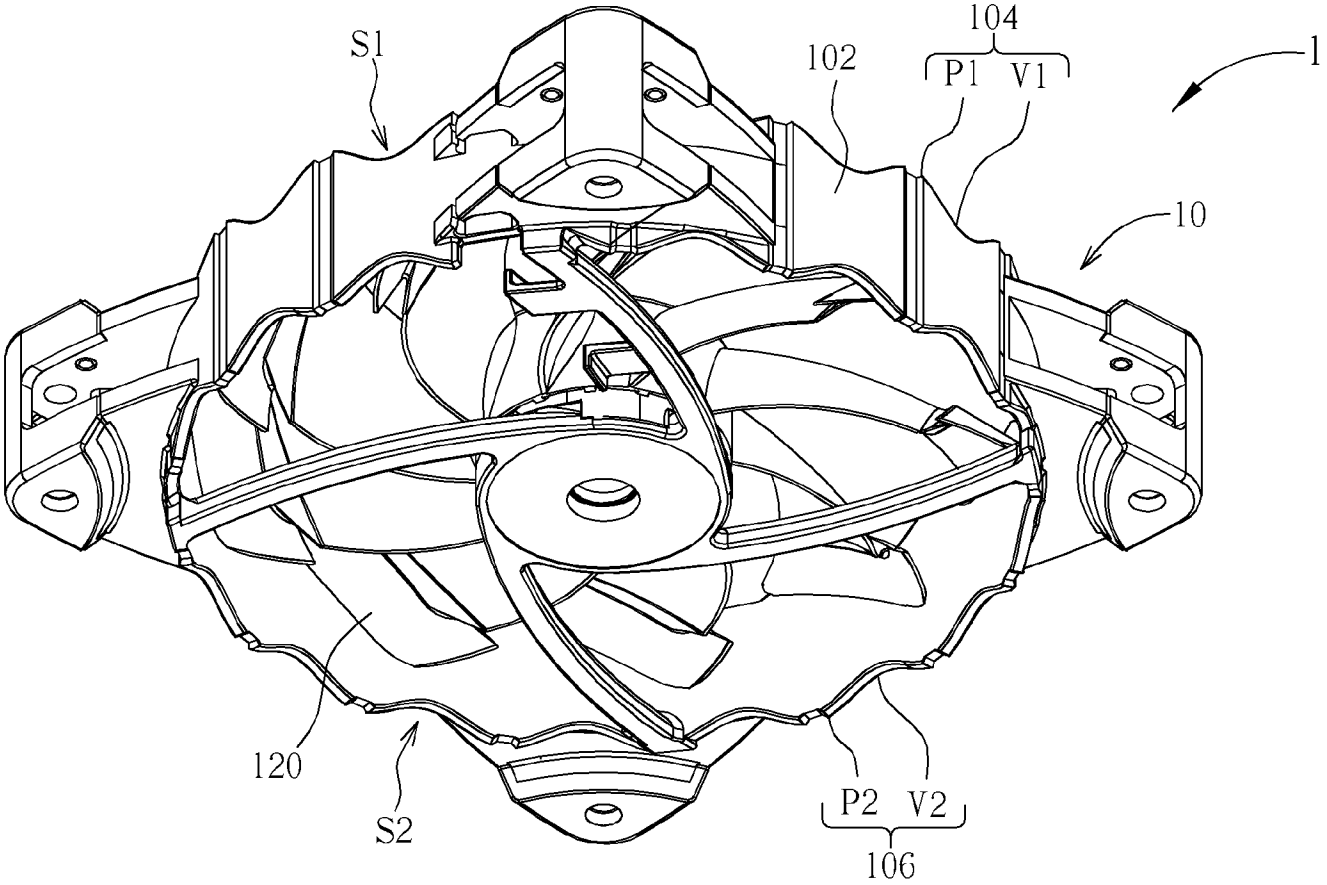
FIG. 2 is a bottom perspective view illustrating the fan shown in FIG. 2.
Figure 3:
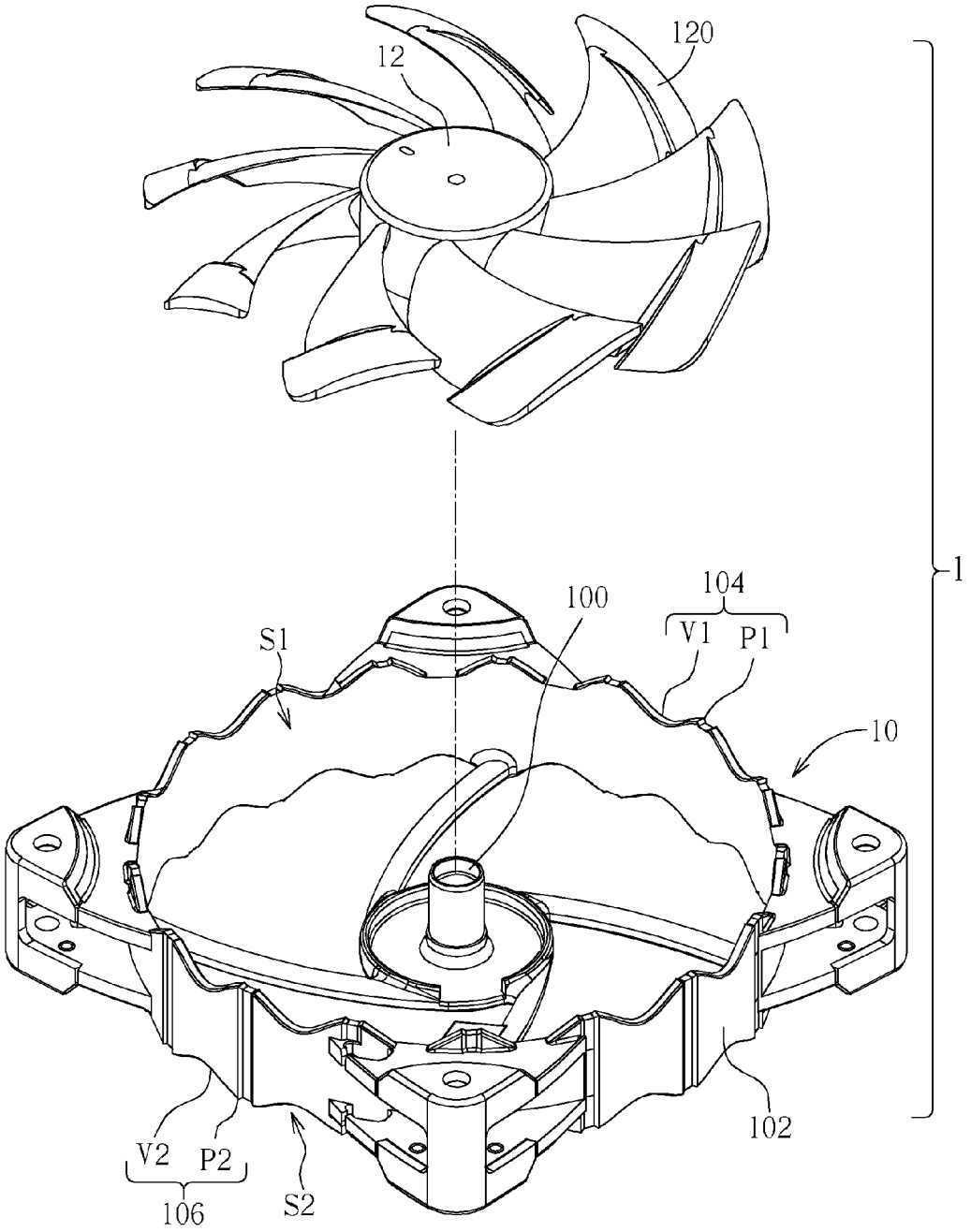
FIG. 3 is an exploded view illustrating the fan shown in FIG. 1.
Figure 4:
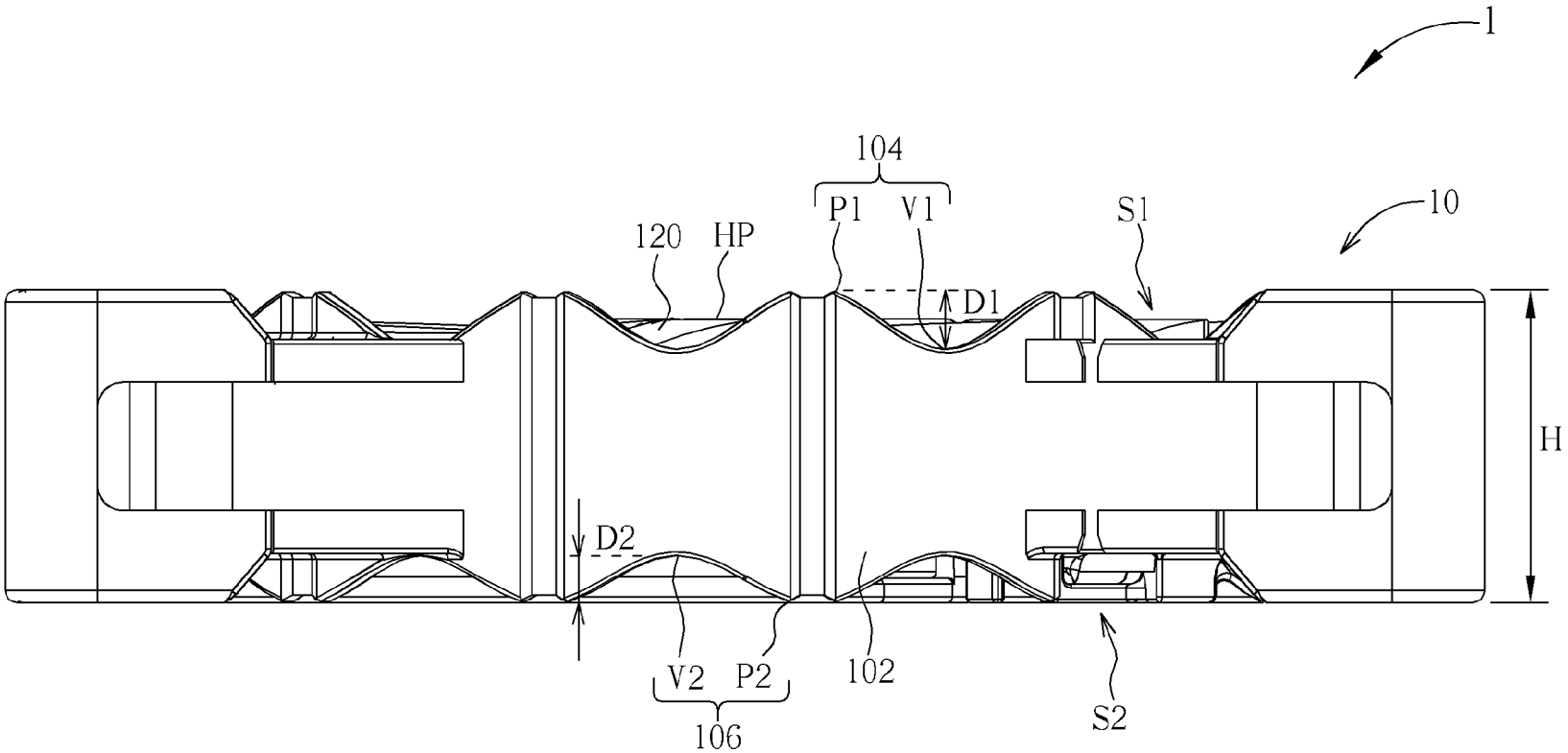
FIG. 4 is a side view illustrating the fan shown in FIG. 1.

Referring to FIGS. 1 to 4, FIG. 1 is a top perspective view illustrating a fan 1 according to a first embodiment of the invention, FIG. 2 is a bottom perspective view illustrating the fan 1 shown in FIG. 2, FIG. 3 is an exploded view illustrating the fan 1 shown in FIG. 1, and FIG. 4 is a side view illustrating the fan 1 shown in FIG. 1. As shown in FIGS. 1 to 4, the fan 1 comprises a fan frame 10 and a fan wheel 12. The fan wheel 12 is pivotally connected to a hub 100 (as shown in FIG. 3) on a bottom of the fan frame 10 so as to be rotatably disposed in the fan frame 10. The fan wheel 12 comprises a plurality of blades 120.

The fan frame 10 comprises a frame body 102, a first waved structure 104 and a second waved structure 106. The frame body 102 has a wind enter side S1 and a wind exhaust side S2, wherein the wind enter side S1 is opposite to the wind exhaust side S2. The first waved structure 104 is formed on the wind enter side S1 of the frame body 102. The first waved structure 104 has a plurality of first peaks P1 and a plurality of first valleys V1, wherein the first peaks P1 and the first valleys V1 are arranged separately, as shown in FIG. 1. Furthermore, the second waved structure 106 is formed on the wind exhaust side S2 of the frame body 102. The second waved structure 106 has a plurality of second peaks P2 and a plurality of second valleys V2, wherein the second peaks P2 and the second valleys V2 are arranged separately, as shown in FIG. 2. In this embodiment, the first waved structure 104 is formed on, but not limited to, a circular edge of the wind enter side S1 of the frame body 102 and the second waved structure 106 is formed on, but not limited to, a circular edge of the wind exhaust side S2 of the frame body 102. Moreover, the first peaks P1 are opposite to the second peaks P2 and the first valleys V1 are opposite to the second valleys V2.

As shown in FIG. 4, the frame body 102 has a height H, a first distance D1 is between the first peak P1 and the first valley V1, and a second distance D2 is between the second peak P2 and the second valley V2. In this embodiment, the relation of H, D1 and D2 is, but not limited to, $0.5H \leq D1 \leq 0.6H$ and D1=D2. Furthermore, after assembling the fan 1, a highest point HP of each blade 120 is located between the first peak P1 and the first valley V1. Accordingly, when the fan wheel 12 rotates, the first waved structure 104 can enhance wind rate and wind current which the blades 120 draws into the frame body 102 of the fan frame 10 and the second waved structure 106 can enhance wind rate and wind current which the blades 120 draws out of the frame body 102 of the fan frame 10, so as to improve heat dissipating effect generated by the fan 1.

Figure 5:
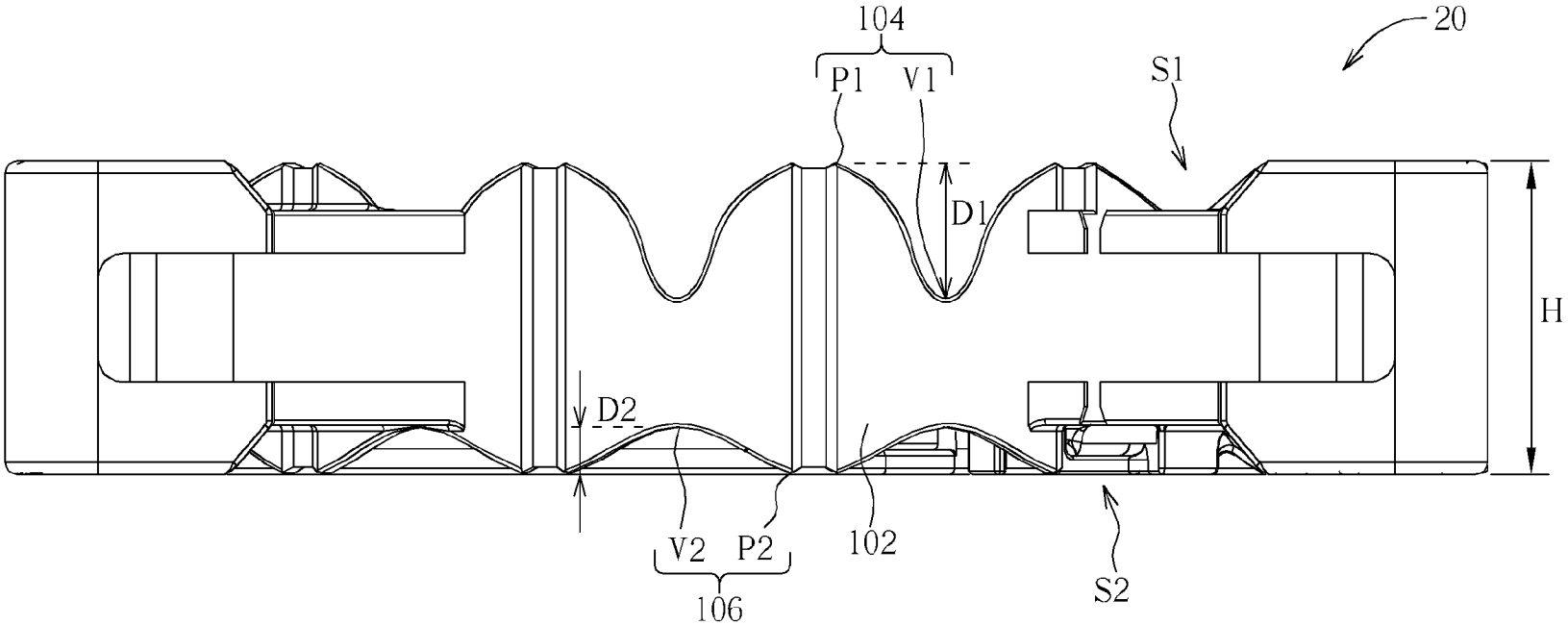
FIG. 5 is a side view illustrating a fan frame according to a second embodiment of the invention.

Referring to FIG. 5 along with FIG. 4, FIG. 5 is a side view illustrating a fan frame 20 according to a second embodiment of the invention. The difference between the fan frame 20 and the aforesaid fan frame 10 is that the first distance D1 between the first peak P1 and the first valley V1 of the first waved structure 104 is larger than the second distance D2 between the second peak P2 and the second valley V2 of the second waved structure 106 (i.e. D1>D2). The fan frame 10 shown in FIGS. 1 to 4 can be replaced by the fan frame 20 shown in FIG. 5. Accordingly, when the fan wheel 12 rotates, the first waved structure 104 can further enhance wind rate and wind current which the blades 120 draws into the frame body 102 of the fan frame 10, so as to improve heat dissipating effect generated by the fan 1. It should be noted that the same elements in FIG. 5 and FIG. 4 are represented by the same numerals, so the repeated explanation will not be depicted herein again.

Figure 6:
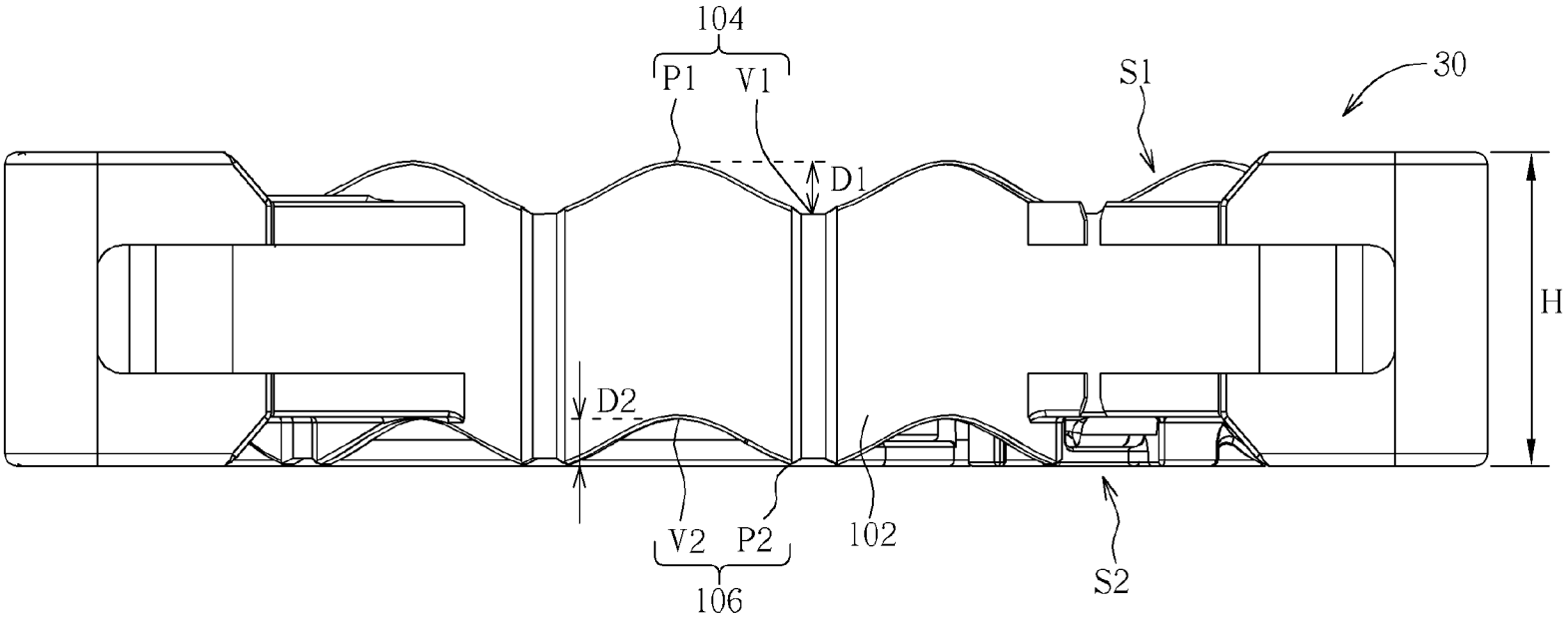
FIG. 6 is a side view illustrating a fan frame according to a third embodiment of the invention.

Referring to FIG. 6 along with FIG. 4, FIG. 6 is a side view illustrating a fan frame 30 according to a third embodiment of the invention. The difference between the fan frame 30 and the aforesaid fan frame 10 is that the first peaks P1 of the first waved structure 104 are opposite to the second valleys V2 of the second waved structure 106 and the first valleys V1 of the first waved structure 104 are opposite to the second peaks P2 of the second waved structure 106. In other words, the related positions of the first peaks P1, first valleys V1, second peaks P2 and second valleys V2 can be adjusted according to desired wind rate and wind current. It should be noted that the same elements in FIG. 6 and FIG. 4 are represented by the same numerals, so the repeated explanation will not be depicted herein again.

Figure 7:
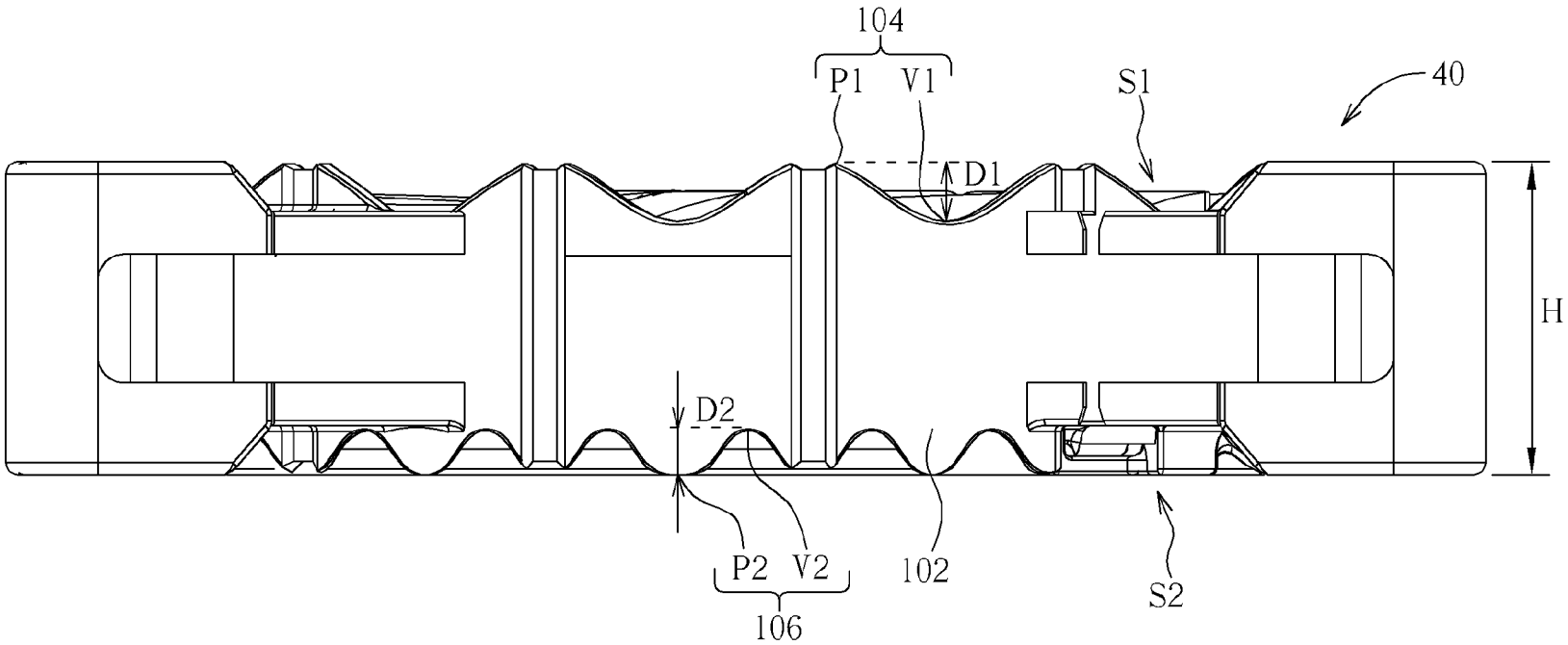
FIG. 7 is a side view illustrating a fan frame according to a fourth embodiment of the invention.

Referring to FIG. 7 along with FIG. 4, FIG. 7 is a side view illustrating a fan frame 40 according to a fourth embodiment of the invention. The difference between the fan frame 40 and the aforesaid fan frame 10 is that a number of the second peaks P2 and the second valleys V2 of the second waved structure 106 are larger than a number of the first peaks P1 and the first valleys V1 of the first waved structure 104. In other words, the number of the first peaks P1, first valleys V1, second peaks P2 and second valleys V2 can be adjusted according to desired wind rate and wind current. It should be noted that the same elements in FIG. 7 and FIG. 4 are represented by the same numerals, so the repeated explanation will not be depicted herein again.

Figure 8:
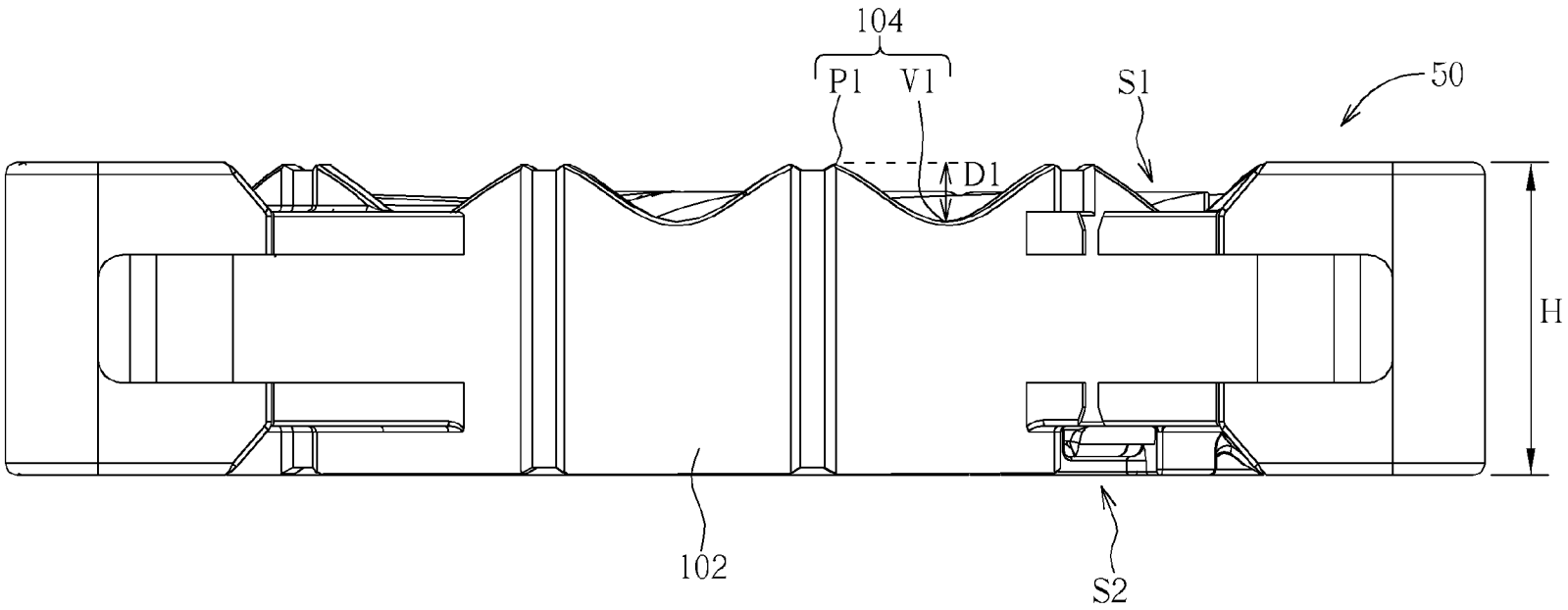
FIG. 8 is a side view illustrating a fan frame according to a fifth embodiment of the invention.

Referring to FIG. 8 along with FIG. 4, FIG. 8 is a side view illustrating a fan frame 50 according to a fifth embodiment of the invention. The difference between the fan frame 50 and the aforesaid fan frame 10 is that the fan frame 50 comprises the first waved structure 104 only and does not comprise the second waved structure 106. In other words, after replacing the fan frame 10 shown in FIGS. 1 to 4 with the fan frame 50 shown in FIG. 8, the fan frame 50 utilizes the first waved structure 104 to enhance wind rate and wind current which the blades 120 draws into the frame body 102 of the fan frame 10, so as to improve heat dissipating effect generated by the fan. It should be noted that the same elements in FIG. 8 and FIG. 4 are represented by the same numerals, so the repeated explanation will not be depicted herein again.

As mentioned in the above, the invention forms the first waved structure on the wind enter side of the frame body of the fan frame. When the fan wheel rotates, the first waved structure can enhance wind rate and wind current which the blades of the fan wheel draws into the fan frame, so as to improve heat dissipating effect generated by the fan. Furthermore, the invention may further form the second waved structure on the wind exhaust side of the frame body of the fan frame. The second waved structure can enhance wind rate and wind current which the blades of the fan wheel draws out of the fan frame, so as to improve heat dissipating effect generated by the fan.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fan comprising:

a fan frame comprising:

a frame body having a wind enter side and a wind exhaust side, the wind enter side being opposite to the wind exhaust side;

a first waved structure formed on the wind enter side of the frame body, the first waved structure having a plurality of first peaks and a plurality of first valleys, the first peaks and the first valleys being arranged separately; and a second waved structure formed on the wind exhaust side of the frame body, the second waved structure having a plurality of second peaks and a plurality of second valleys, the second peaks and the second valleys being arranged separately; and a fan wheel rotatably disposed in the fan frame.

2. The fan of claim 1, wherein the fan wheel comprises a plurality of blades and a highest point of each blade is located between the first peak and the first valley.

3. The fan of claim 1, wherein the frame body has a height H, a first distance D1 is between the first peak and the first valley, and $0.5H \leq D1 \leq 0.6H$.

4. The fan of claim 1, wherein a first distance D1 is between the first peak and the first valley, a second distance D2 is between the second peak and the second valley, and D1>D2.

5. The fan of claim 1, wherein the first peaks are opposite to the second peaks and the first valleys are opposite to the second valleys.

6. The fan of claim 1, wherein the first peaks are opposite to the second valleys and the first valleys are opposite to the second peaks.

7. The fan of claim 1, wherein a number of the second peaks and the second valleys are larger than a number of the first peaks and the first valleys.

8. A fan frame comprising:

a frame body having a wind enter side and a wind exhaust side, the wind enter side being opposite to the wind exhaust side;

a first waved structure formed on the wind enter side of the frame body, the first waved structure having a plurality of first peaks and a plurality of first valleys, the first peaks and the first valleys being arranged separately; and a second waved structure formed on the wind exhaust side of the frame body, the second waved structure having a plurality of second peaks and a plurality of second valleys, the second peaks and the second valleys being arranged separately.

9. The fan frame of claim 8, wherein the frame body has a height H, a first distance D1 is between the first peak and the first valley, and $0.5H \leq D1 \leq 0.6H$.

10. The fan frame of claim 8, wherein a first distance D1 is between the first peak and the first valley, a second distance D2 is between the second peak and the second valley, and $D1 > D2$.

11. The fan frame of claim 8, wherein the first peaks are opposite to the second peaks and the first valleys are opposite to the second valleys.

12. The fan frame of claim 8, wherein the first peaks are opposite to the second valleys and the first valleys are opposite to the second peaks.

13. The fan frame of claim 8, wherein a number of the second peaks and the second valleys are larger than a number of the first peaks and the first valleys.

* * * * *